US006021288A

United States Patent [19]

Okuno et al.

[11] Patent Number: 6,021,288

[45] Date of Patent: Feb. 1, 2000

[54] IMAGE FORMING APPARATUS

[75] Inventors: Yukihiko Okuno, Toyokawa; Masaki Tanaka; Toshifumi Watanabe, both of Toyohashi, all of Japan

[73] Assignee: Minolta Co., Ltd., Osaka, Japan

[21] Appl. No.: 09/157,495

[22] Filed: Sep. 21, 1998

[30] Foreign Application Priority Data

Sep. 22, 1997 [JP] Japan ..... 9-257116

[51] Int. Cl.[7] ..... G03G 15/00

[52] U.S. Cl. ..... 399/72; 399/49; 399/50; 399/51; 399/55

[58] Field of Search ..... 399/72, 49, 55, 399/50, 51

[56] References Cited

U.S. PATENT DOCUMENTS 4,853,738 8/1989 Rushing .
5,294,959 3/1994 Nagao et al. .
5,436,705 7/1995 Raj .
5,583,644 12/1996 Sasanuma et al. ..... 358/296

FOREIGN PATENT DOCUMENTS 05113723 7/1993 Japan .

*Primary Examiner*—Richard Moses
*Attorney, Agent, or Firm*—McDermott, Will & Emery

[57] ABSTRACT

A digital copying machine develops an electrostatic latent image formed on a photosensitive drum with toner, and transfers the developed image onto a sheet. In forming images on the photosensitive drum successively, three types of test patterns are formed in order in intro-image areas between image forming areas, and AIDC is made. The first test pattern is a low-density pattern, the second test pattern is an intermediate-density pattern, and the third test pattern is a high-density pattern.

18 Claims, 9 Drawing Sheets

IMAGE FORMING APPARATUS

This application is based on application No. 9-257116 filed in Japan, the contents of which are hereby incorporated by reference.

BACKGROUND OF THE INVENTION

1. Field of the Invention

The present invention relates to an image forming apparatus, and more specifically, relates to an image forming apparatus for developing an electrostatic latent image formed on an image carrier and transferring the developed image onto a sheet.

2. Description of Related Art

Conventionally, in the field of electrophotographic copying machine and laser printer, in order to stabilize the picture quality, AIDC (auto image density control) is made in such a manner that a test pattern is formed on a photosensitive layer under predetermined image forming conditions, that the density of toner attracted onto the test pattern is detected optically by a sensor and that the detected density is fed back into the image forming conditions (toner supply to a development tank or charging voltage of the photosensitive layer, an exposed light amount, a development bias voltage, etc.).

In the AIDC, in order to stabilize the picture quality more accurately, it is preferable that test patterns of plural densities (for example, three types: low-density pattern P1, intermediate-density pattern P2 and high-density pattern P3) are formed, and their densities are detected so that the detected densities are fed back into correction control of the image forming conditions. However, if in multi-copying (plural copies are formed successively by one copy start signal), three types of test patterns are formed in an intro-image area between image forming areas and are subjected to density detection, the intro-image area is widened, thereby causing problems that a copy speed is lowered and that toner consumption is increased.

Therefore, in a conventional example, as shown in FIG. 11*a*, the intermediate-density pattern P2 is formed for AIDC every time when an image is formed on one sheet, and all the patterns P1, P2 and P3 are formed for AIDC when the last copy in multi-copying has been made. However, in this method, when the number of copies made in multi-copying is increased (detection of only one kind of the pattern P2 is continued), it is inevitable to lower the accuracy of the detection.

As its reform measure, as shown in FIG. 11*b*, a method, in which every time multi-copying on a specified number of sheets is completed (for example, copying on 25 sheets is completed), the three types of test patterns P1, P2 and P3 are formed for AIDC, is also suggested. However, this is not a drastic solution, since AIDC based on detection of only one type of the intermediate-density pattern P2 is continued during printing on the specified number of sheets.

SUMMARY OF THE INVENTION

Therefore, it is an object of the present invention to provide an image forming apparatus which can form test patterns of plural levels without lowering the image forming speed and can improve the accuracy of AIDC.

In order to achieve the above object, an image forming apparatus according to the present invention comprises a test pattern forming device for forming test patterns with different image forming levels on an image carrier, a detecting device for detecting the image forming levels of the test patterns, and a control device for controlling the test pattern forming device to form test patterns with different image forming levels every time a specified member of image forming processes are completed and controlling an image forming condition based on detected results of the detecting device.

According to the present invention, the test patterns with different image forming levels are formed in order, for example, every time a print process on one sheet is completed, or every time print processes on two sheets are completed, and their image forming levels are detected. With this arrangement, plural types of image forming levels can be detected in constant rotation. Compared with the conventional method of obtaining results of only one type of image forming level continuously, accuracy of detection of the image forming levels is improved, and satisfactory image stabilization control can be achieved. Moreover, the image forming speed is not lowered.

In the present invention, the test patterns may be toner patterns or ink patterns with different densities, and may be electric potential patterns with different electric potentials. As for the toner patterns and ink patterns, the densities are detected by an optical sensor, and as for the electric potential patterns, the potentials are detected by an electric potential sensor. Moreover, the image forming condition controlled in order to stabilize the picture quality in an electrophotographic printer is at least one of a toner density in a developing device, a charging voltage of the image carrier, an exposed light amount and a development bias voltage, and in the case of a digital-type printer, the condition includes a $\gamma$ correction coefficient.

BRIEF DESCRIPTION OF THE DRAWINGS

This and other objects and features of the present invention will become apparent from the following description with reference to the accompanying drawings, in which.

DETAILED DESCRIPTION OF THE PREFERRED EMBODIMENTS

The following describes embodiments of an image forming apparatus of the present invention with reference to the accompanying drawings.

Figure 1:
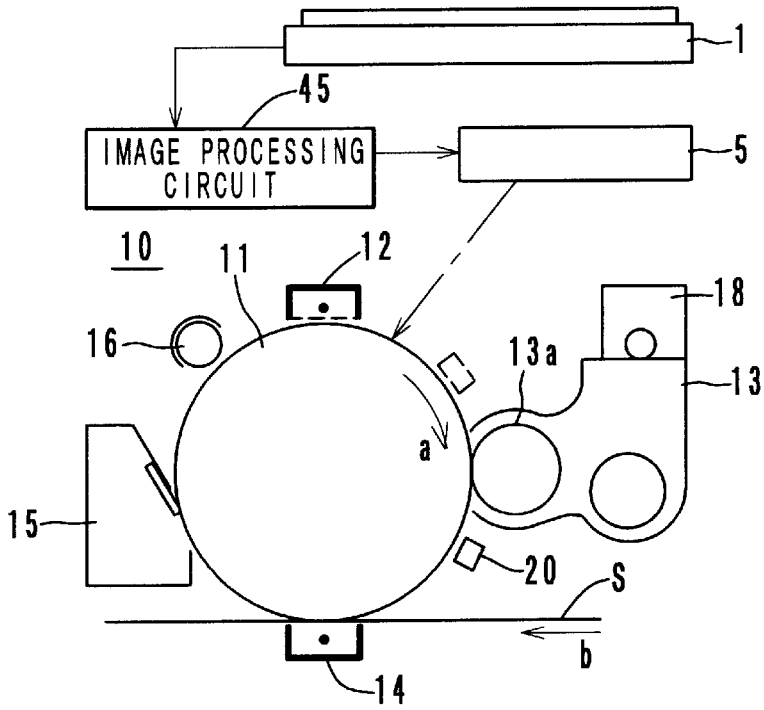
FIG. 1 is a schematic constitutional view of a copying machine according to a first embodiment of the present invention.

In FIG. 1, an image forming apparatus according to the first embodiment of the present invention is structured as a digital-type electrophotographic copying machine, and is composed mainly of an image reader 1 for reading a document image, an image processing circuit 45 for converting the read image information into digital data and performing correction processes such as shading correction and γ correction on the digital data so as to generate printing data, a laser scanning optical unit 5 for modulating a laser beam source based on the printing data so as to form an image (latent image) on a photosensitive drum 11, and an image forming section 10 mainly including the photosensitive drum 11.

The image forming section 10 is provided with a scorotron-type charger 12, a developing device 13, a transfer charger 14, a cleaner 15 for residual toner and a charge eliminating lamp 16 for residual electric charges around the photosensitive drum 11 which is rotated in a direction of an arrow "a". An AIDC sensor 20 is provided just below the developing device 13. This sensor 20 is composed of a light emitting element and a light receiving element (a photoelectric converting element), and its structure is well-known.

First, the photosensitive drum 11 is charged uniformly so as to have a specified voltage by the charger 12, and an electrostatic latent image is formed by a laser beam emitted from the laser scanning optical unit 5. This latent image is developed by toner supplied from a developing sleeve 13*a* of the developing device 13, and is transferred on a sheet S which is transported in a direction of an arrow "b" by an electric field discharged from the transfer charger 14. The toner image transferred on the sheet S is fixed on the sheet S by a fixing device (not shown), and the sheet S is discharged from the machine.

In the digital-type copying machine of the first embodiment, when the photosensitive drum 11 which is charged uniformly so as to have a specified voltage (for example, voltage Vo with negative polarity) is exposed to a light with image information, a negative electrostatic latent image is formed with image portions lowered nearly to an electric potential of zero. When toner charged with the same polarity as that of the photosensitive layer is supplied to the electrostatic latent image, the toner is attracted to the image portions (low electric potential portions), so that the image is developed. At this development, a development bias voltage Vb which is slightly lower than the potential Vo of the photosensitive layer is applied to the developing sleeve 13*a*, and this helps the toner be attracted to the low electric potential portions.

Control for stabilization of picture quality which is called as AIDC is made by using the sensor 20. Specifically, a test pattern is formed on the photosensitive drum 11 under specified image forming conditions, the density of toner attracted to the test pattern is detected optically by the sensor 20, and the supply of toner to a development tank, the photosensitive layer charging voltage, the exposed light amount, the development bias voltage, the coefficient of γ correction performed by the image processing circuit 45, etc. are adjusted so that a predetermined image density can be obtained.

Figure 2:
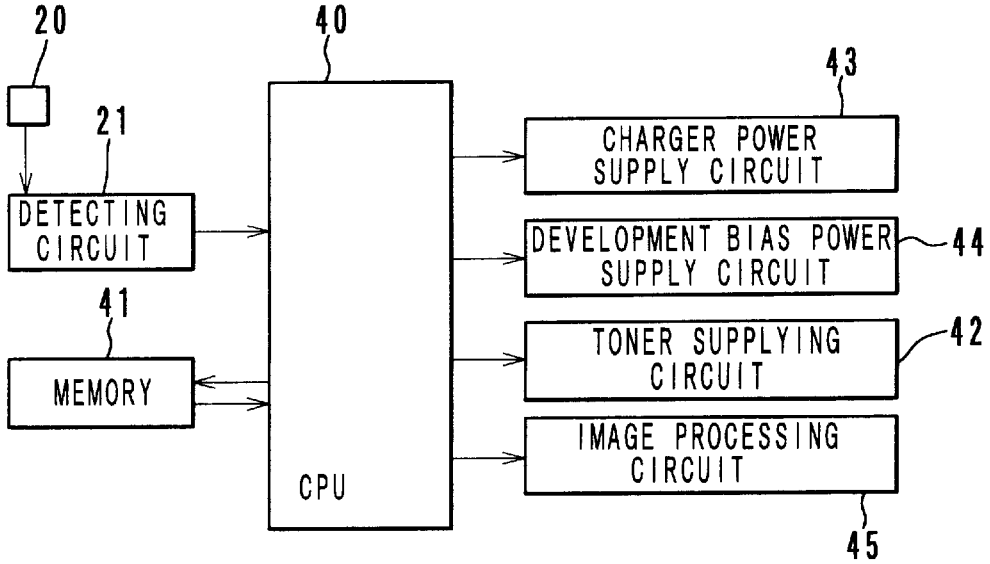
FIG. 2 is a block diagram showing the main section of a control circuit of the copying machine.

As shown in FIG. 2, a density detecting signal (voltage) of the sensor 20 is transmitted to a detecting circuit 21, and it is converted into toner attracted amount information in the detecting circuit 21 so as to be inputted into a CPU 40, and the toner attracted amount information is stored in a memory 41. In the CPU 40, a developing efficiency is calculated from the toner attracted amount information stored in the memory 41. The toner density in a developer is presumed based on the calculated developing efficiency, and a toner supplying amount is determined. The CPU 40 outputs the specified driving signals into the toner supplying circuit 42 which controls a supplying motor of a toner hopper 18. Moreover, a value of Δ V is calculated based on the developing efficiency, and a grid voltage Vg (corresponding to the photosensitive layer charging voltage) of the charger 12, the development bias voltage Vb and the coefficient of γ correction are determined. Then, the CPU 40 outputs the respective control signals into the charger power supply circuit 43, the development bias power supply circuit 44 and the image processing circuit 45.

In order to perform the AIDC, the CPU 40 contains various look-up tables, and control data are operated referring to these tables. The following tables 1, 2 and 3 are examples of the look-up tables.

Table 1 is used for converting a detected value of the sensor 20 into a toner attracted amount. Table 2 shows a presumed value of the toner density in a developer based on a developing efficiency operated from the test pattern forming condition (Δ V) and from the converted toner attracted amount. When the presumed toner density is lower than a reference value, toner is supplied. Here, as for Table 2, some kinds of tables are prepared according to the absolute humidity at the time of detection. Table 3 shows set values Δ V, Vg, Vb and γ correction coefficients which are the image forming conditions (parameters) based on the developing efficiency.

TABLE 1

| Sensor detected value (V) | Toner attracted amount ($mg/cm^2$) |
|---|---|
| 4.2 | 0.0 |
| 4.1 | 0.1 |
| 4.0 | 0.2 |
| 3.9 | 0.3 |
| . | . |
| . | . |
| . | . |
| . | . |
| . | . |
| . | . |
| . | . |
| . | . |
| . | . |
| . | . |
| . | . |
| . | . |
| . | . |
| . | . |
| . | . |
| 1.0 | 0.60 |
| 0.9 | 0.61 |
| 0.8 | 0.62 |
| 0.7 | 0.63 |
| . | . |
| 0.0 | 0.70 |

TABLE 2

| Absolute humidity: 5 $g/cm^3$ | |
|---|---|
| Developing efficiency ($mg/cm^2$/100 V) | Presumed toner density (%) |
| 0.010 | 0.050 |
| 0.015 | 0.052 |
| 0.020 | 0.054 |

TABLE 2-continued

| Absolute humidity: 5 g/cm³ | |
|---|---|
| Developing efficiency (mg/cm²/100 V) | Presumed toner density (%) |
| 0.025 | 0.056 |
| . | . |
| . | . |
| . | . |
| . | . |
| . | . |
| . | . |
| 0.100 | 3.500 |
| 0.105 | 3.530 |
| 0.115 | 3.560 |
| 0.115 | 3.590 |
| . | . |
| . | . |
| . | . |
| . | . |
| . | . |
| . | . |
| . | . |
| . | . |
| . | . |
| 0.380 | 7.850 |
| 0.385 | 7.900 |
| 0.390 | 7.950 |
| 0.395 | 7.980 |
| 0.400 | 8.000 |

TABLE 3

| Developing efficiency | ΔV | Vg | Vb | γ correction coefficient |
|---|---|---|---|---|
| 0.609 | 115 | 450 | 235 | γ 1 |
| 0.574 | 123 | 460 | 243 | γ 2 |
| 0.538 | 130 | 470 | 250 | γ 3 |
| 0.488 | 145 | 485 | 265 | γ 4 |
| 0.438 | 160 | 500 | 280 | γ 5 |
| 0.403 | 175 | 520 | 298 | γ 6 |
| 0.368 | 190 | 540 | 315 | γ 7 |
| 0.336 | 210 | 560 | 335 | γ 8 |
| 0.304 | 230 | 580 | 355 | γ 9 |
| 0.282 | 250 | 605 | 378 | γ 10 |
| 0.259 | 270 | 630 | 400 | γ 11 |
| 0.243 | 290 | 650 | 420 | γ 12 |
| 0.226 | 310 | 670 | 440 | γ 13 |
| 0.213 | 330 | 700 | 465 | γ 14 |
| 0.200 | 350 | 730 | 490 | γ 15 |
| 0.190 | 370 | 755 | 510 | γ 16 |
| 0.179 | 390 | 780 | 530 | γ 17 |
| 0.169 | 415 | 810 | 558 | γ 18 |
| 0.159 | 440 | 840 | 585 | γ 19 |
| 0.151 | 465 | 865 | 610 | γ 20 |
| 0.143 | 490 | 890 | 635 | γ 21 |
| 0.137 | 515 | 925 | 663 | γ 22 |
| 0.130 | 540 | 960 | 690 | γ 23 |

In the first embodiment, in order to improve the accuracy of the AIDC, three kinds of test patterns, namely, a low-density test pattern P1 (ΔV: 100 V), an intermediate-density test pattern P2 (ΔV: 150 V) and a high-density test pattern P3 (Δ V: 200 V) are formed. Examples of their formations are shown in FIGS. 3*a*, 3*b* and 3*c*.

Figures 3A, 3B, 3C:
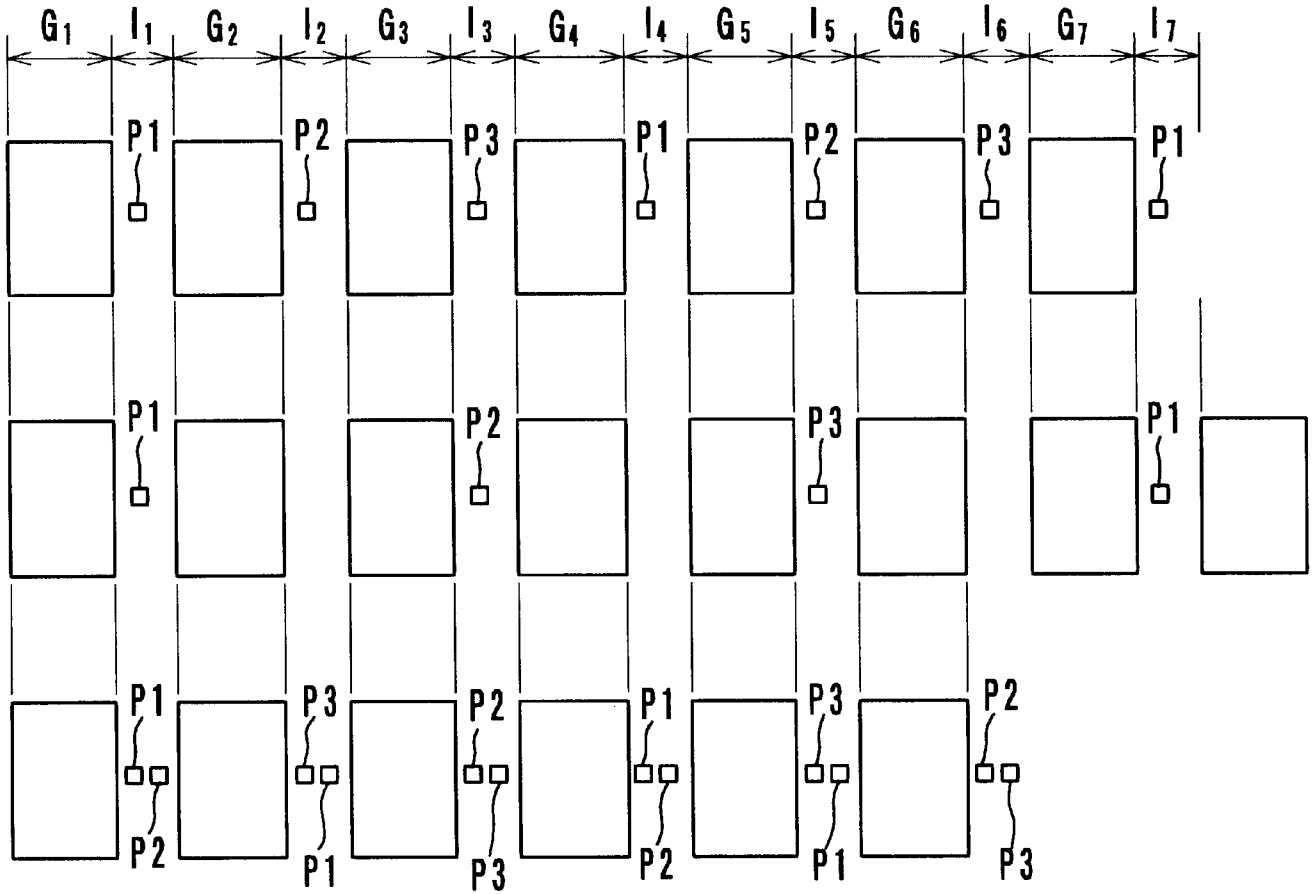
FIGS. 3*a*, 3*b* and 3*c* are charts showing a first example, a second example and a third example of test pattern formations according to the present invention.

In the first example shown in FIG. 3*a*, during multi-copying, the patterns P1, P2 and P3 are formed successively every after a copying process on one sheet, that is, on intro-image areas $I_1$, $I_2$ . . . between image forming areas $G_1$, $G_2$ . . . of the photosensitive drum 11, and their toner densities are detected by the sensor 20 and the AIDC is made. In the second example shown in FIG. 3*b*, during multi-copying, the patterns P1, P2 and P3 are formed successively every after copying processes on two sheets, that is, on the intro-image areas $I_1$, $I_3$, $I_5$, $I_7$ . . . , and their toner densities are detected by the sensor 20 and the AIDC is made. In the third example shown in FIG. 3*c*, the patterns in the combinations of (P1, P2), (P3, P1) and (P2, P3) are formed successively every after a copying process, that is, on the intro-image areas $I_1$, $I_2$, $I_3$ . . . , and their toner densities are detected by the sensor 20 and the AIDC is made.

Figures 11A, 11B:
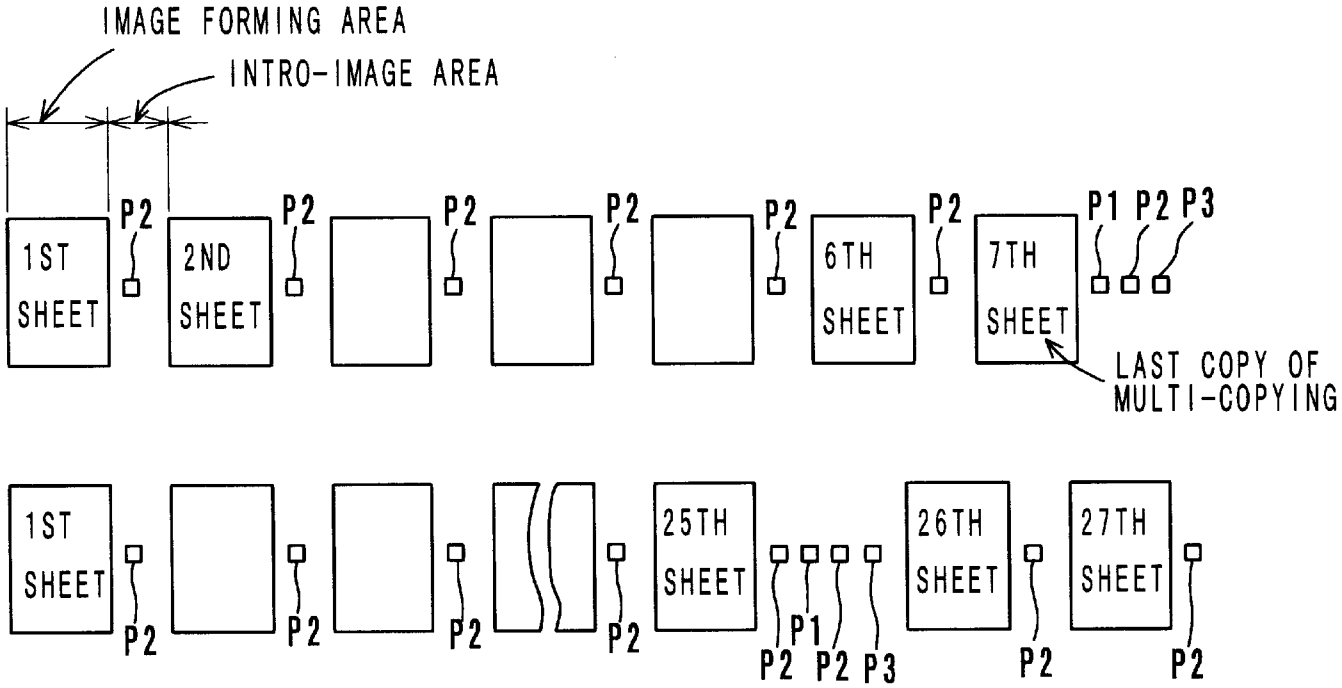
FIGS. 11*a* and 11*b* are charts showing test pattern formations in conventional AIDC.

According to the pattern formations, since the three kinds of patterns P1, P2 and P3 are formed in a specified order during multi-copying and the AIDC is made, compared with the conventional example (see FIGS. 11*a* and 11*b*) in which the AIDC is made continuously based on one type of pattern, the accuracy of detection of toner density is improved, and thus an image of high quality can be always obtained. Moreover, compared with the method of forming three kinds of patterns every after a copying process, the intro-image areas $I_1$, $I_2$ . . . become shorter, the copy speed becomes faster, and toner consumption is reduced.

The following describes the control procedure of the AIDC with reference to FIGS. 4 through 8.

Figure 4:
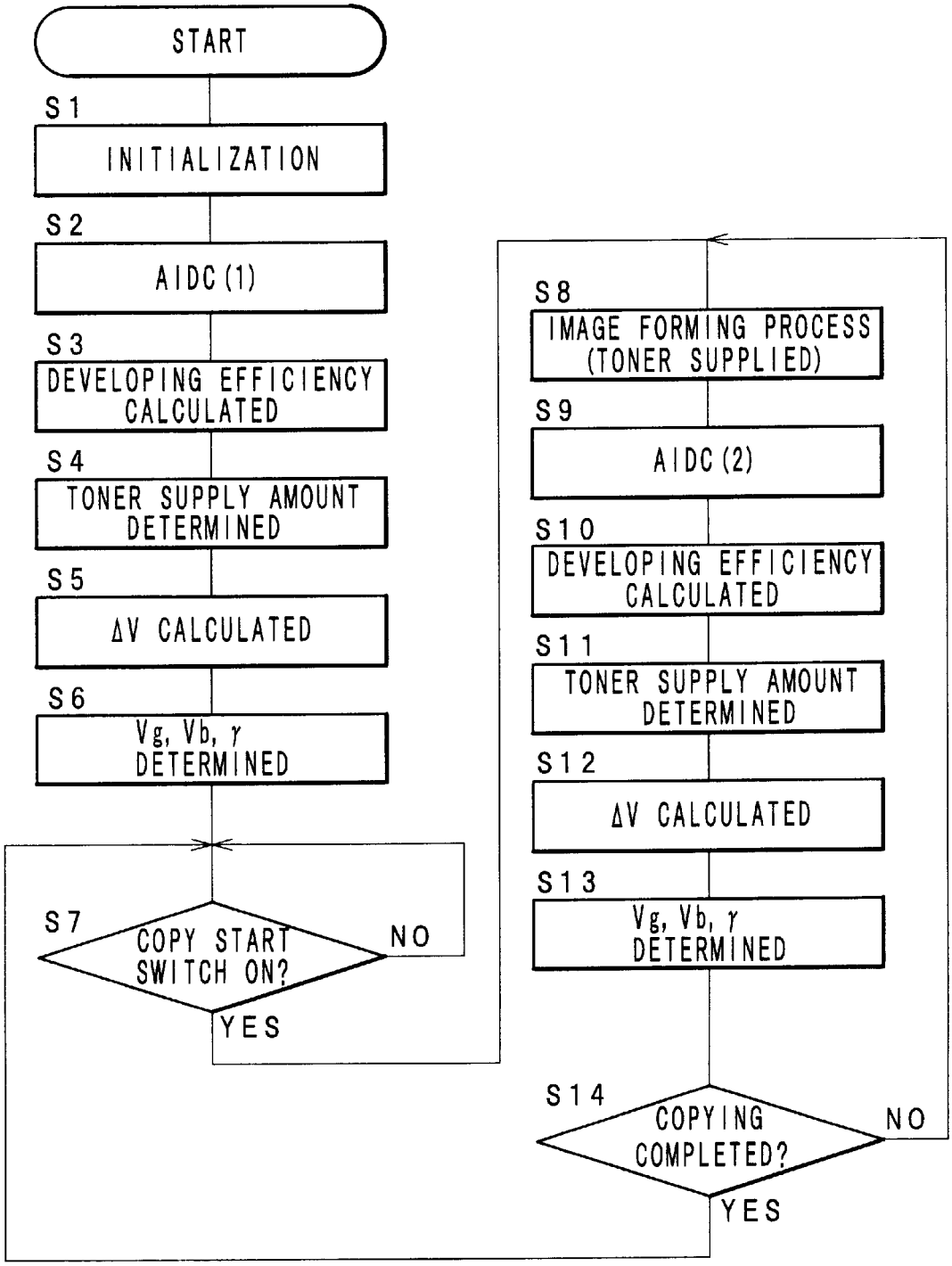
FIG. 4 is a flowchart showing a control procedure (main routine) performed in the control circuit.

FIG. 4 shows the main routine of the CPU 40. When the electric power source of the copying machine is turned on and the program is started, the devices and control parameters are initially set at step S1, and the AIDC (1) is made at step S2.

Figure 5:
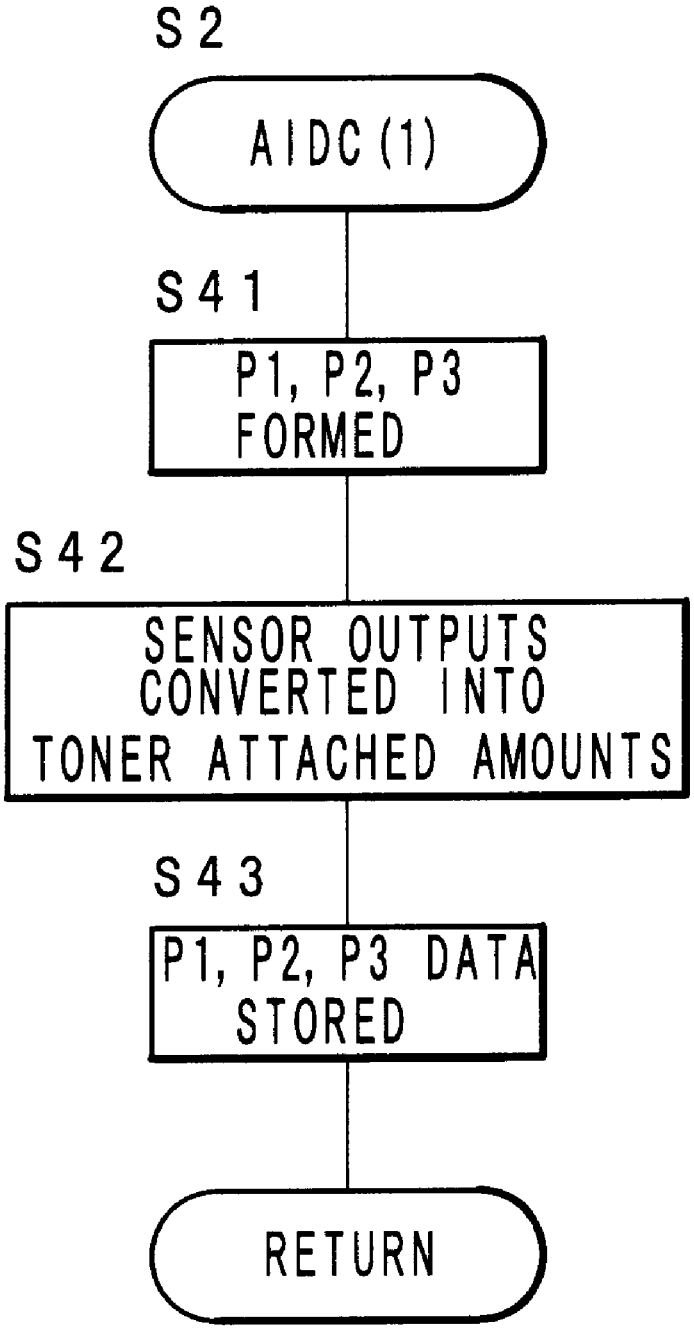
FIG. 5 is a flowchart showing the control procedure for AIDC (1)

The AIDC (1) is made as the starting-up process of the copying machine, and as shown in FIG. 5, the test patterns P1, P2 and P3 are formed on the photosensitive drum 11 at step S41, and their toner densities are obtained as outputs of the sensor 20 at step S42 so that the toner densities are converted into toner attracted amounts. Next, data of P1, P2 and P3 which are the converted values are stored in the memory 41 at step S43.

Referring back to FIG. 4, the developing efficiency is calculated from the data of P1, P2 and P3 stored in the memory 41 at step S3. The developing efficiency is calculated as a slope of a change in the toner attracted amount per 100 V by the method of least square including the data of three points and ΔV at the time of the pattern formation through the origin. Next, the toner supply amount is determined at step S4 based on the toner density presumed by the developing efficiency, and ΔV is calculated at step S5, and the charger grid voltage Vg, the development bias voltage Vb and the γ correction coefficient are determined at step S6.

Thereafter, the sequence waits for a copy start switch being turned on at step S7, and when the copy start switch is turned on, the image forming process is performed at step S8. Here, an image is formed, and toner is supplied based on the control data obtained at steps S4, S5 and S6. Moreover, in image forming processes on and after the second sheet after the power source is turned on, an image is formed, and toner is supplied based on control data obtained at steps S11, S12 and S13, which will be described below.

When an image forming process on one sheet is completed, the AIDC (2) is made at step S9. This is described as the first, second and third examples with reference to FIGS. 6, 7 and 8. The developing efficiencies (in the first and second examples, individual developing efficiencies of the patterns P1, P2 and P3, and in the third example, developing efficiencies of each combination of the patterns (P1, P2), (P3, P1) and (P2, P3)) are calculated at step S10 from data obtained by the AIDC (2). Next, the toner supply amount is determined at step S11 based on the developing efficiencies, and ΔV is calculated at step S12, and the charger grid voltage Vg, the development bias voltage Vb and the γ correction coefficient are determined at step S13.

Next, a judgment is made at step S14 as to whether or not the multi-copying is completed. When the multi-copying is completed, the sequence returns to step S7, and when an image forming process on the next sheet is necessary, the sequence returns to step S8.

Figure 6:
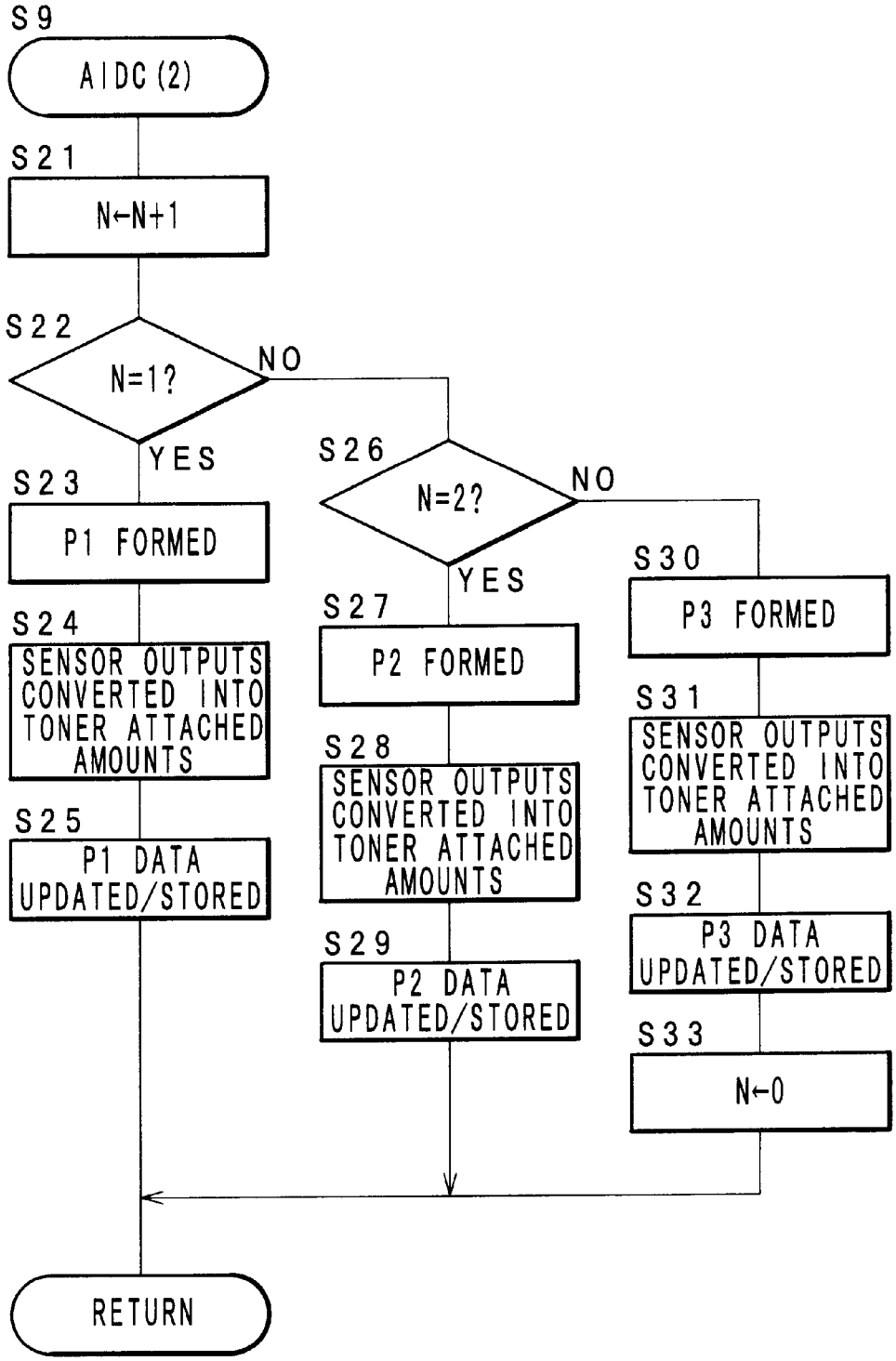
FIG. 6 is a flowchart showing the control procedure for the first example of AIDC (2)

FIG. 6 shows the control procedure of the AIDC (2) made at step S9 in the first example (see FIG. 3*a*).

First, "1" is added to a counter N at step S21, and a judgment is made at steps S22 and S26 as to whether the count value is "1" or "2". When YES (N=1) at step S22, the pattern P2 is formed at step S23, and its density is detected by the sensor 20. Next, the sensor output is converted into a toner attracted amount at step S24, and its value is updated/stored as P1 data in the memory 41. When YES (N=2) at step S26, the same processes as steps S23, S24 and S25 are performed at steps S27, S28 and S29. Moreover, when NO (N=3) at steps S22 and S26, the same processes as steps S23, S24 and S25 are performed at steps S30, S31 and S32, and the counter N is reset to "0" at step S33.

Figure 7:
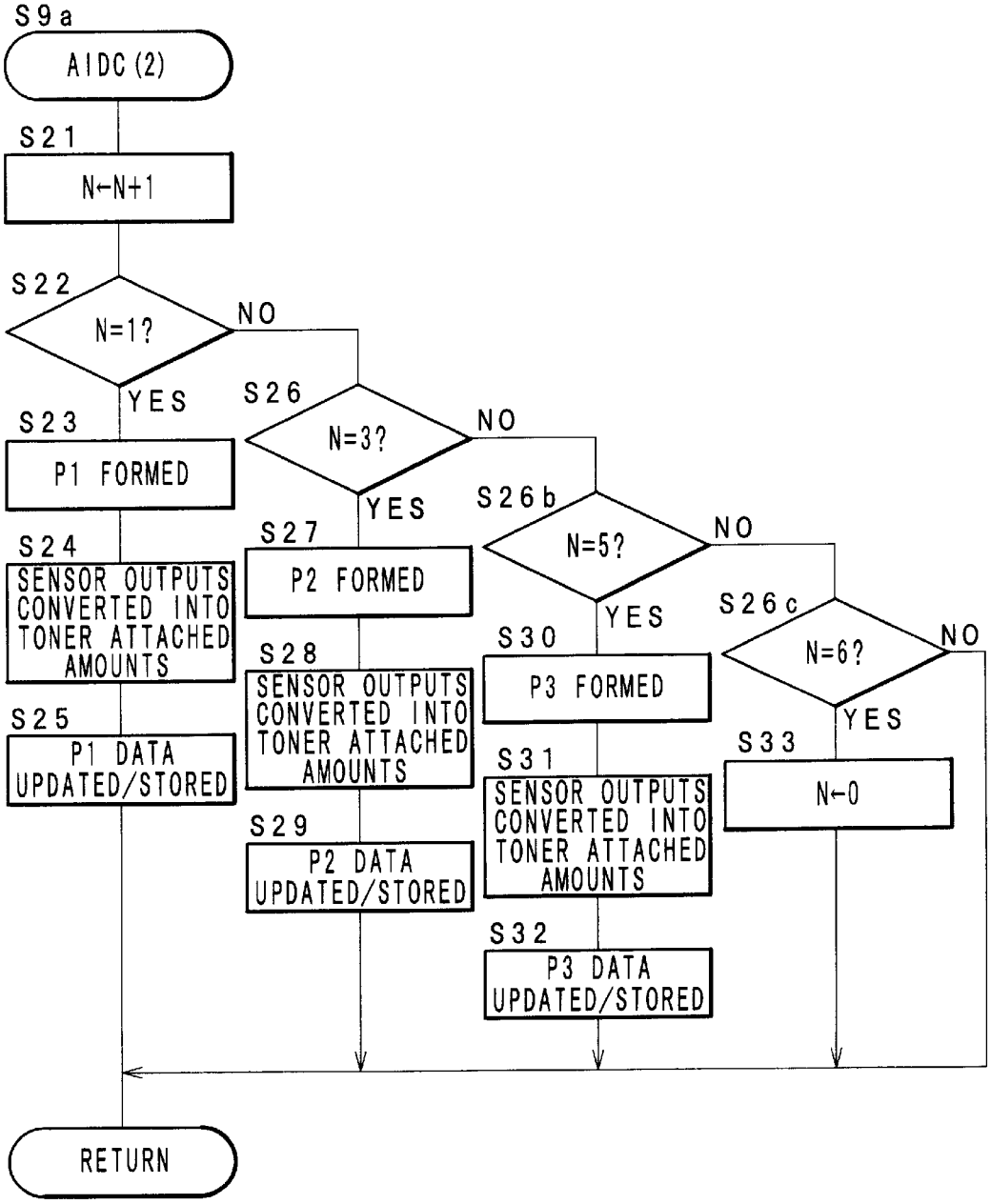
FIG. 7 is a flowchart showing the control procedure for the second example of AIDC (2)

FIG. 7 shows the control procedure of the AIDC (2) made at step S9 in the second example (see FIG. 3*b*).

Steps S21, S23 through S25, S27 through S29 and S30 through S32 are the same processes as those at the corresponding steps in FIG. 6. The value of the counter N is "1" through "6", and a judgment is made at step S22 as to whether or not the count value is "1", at step 26*a* as to whether or not the count value is "3", at step S26*b* as to whether or not the count value is "5", and at step S26*c* as to whether or not the count value is "6". When N=1, the processes at steps S23 through S25 are performed. When N=3, the processes at steps S27 through 29 are performed, and when N=5, the processes at steps S30 through 32 are performed. When N=6, the counter N is reset to "0" at step S33.

Figure 8:
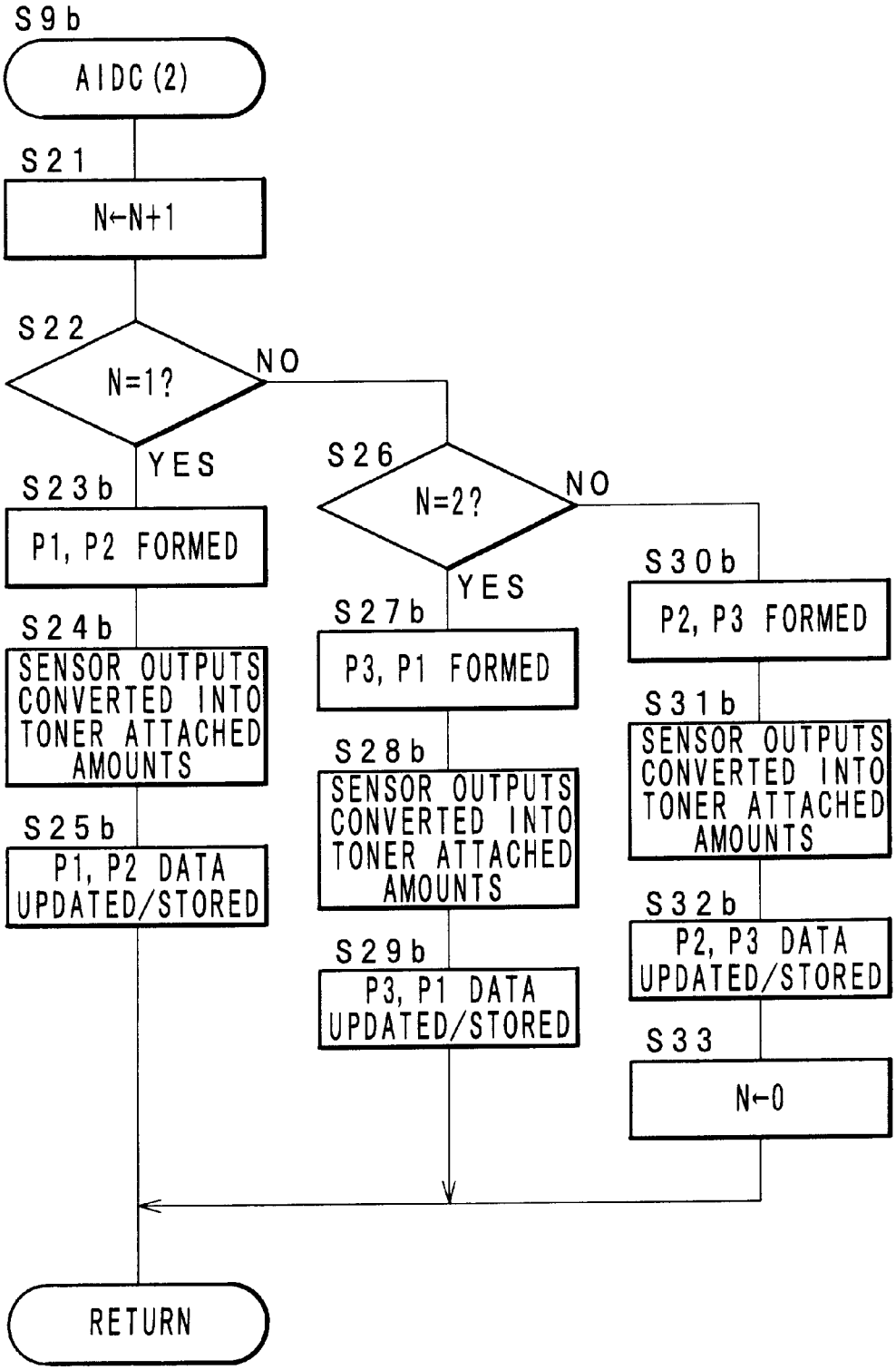
FIG. 8 is a flowchart showing the control procedure for the third example of AIDC (2)

FIG. 8 shows the control process of the AIDC (2) made at step S9 in the third example (see FIG. 3*c*). The processes at steps S21, S22, S26 and S33 are the same processes at the corresponding steps shown in FIG. 6. When N=1, the patterns P1 and P2 are formed at step S23*b*, and their densities are detected by the sensor 20. Next, the sensor outputs are converted into a toner attracted amount at step S24*b*, and the values are updated/stored as P1 and P2 data in the memory 41 at step S25*b*. When N=2, the patterns P3 and P1 are formed at step S27*b*, and processes similar to those at steps S24*b* and S25*b* are performed at steps S28*b* and S29*b*. When N=3, the patterns P2 and P3 are formed at step S30*b*, and processes similar to those at steps S24*b* and S25*b* are performed at steps S31*b* and S32*b*. Then, the counter N is reset to "0" at step S33.

Figure 9:
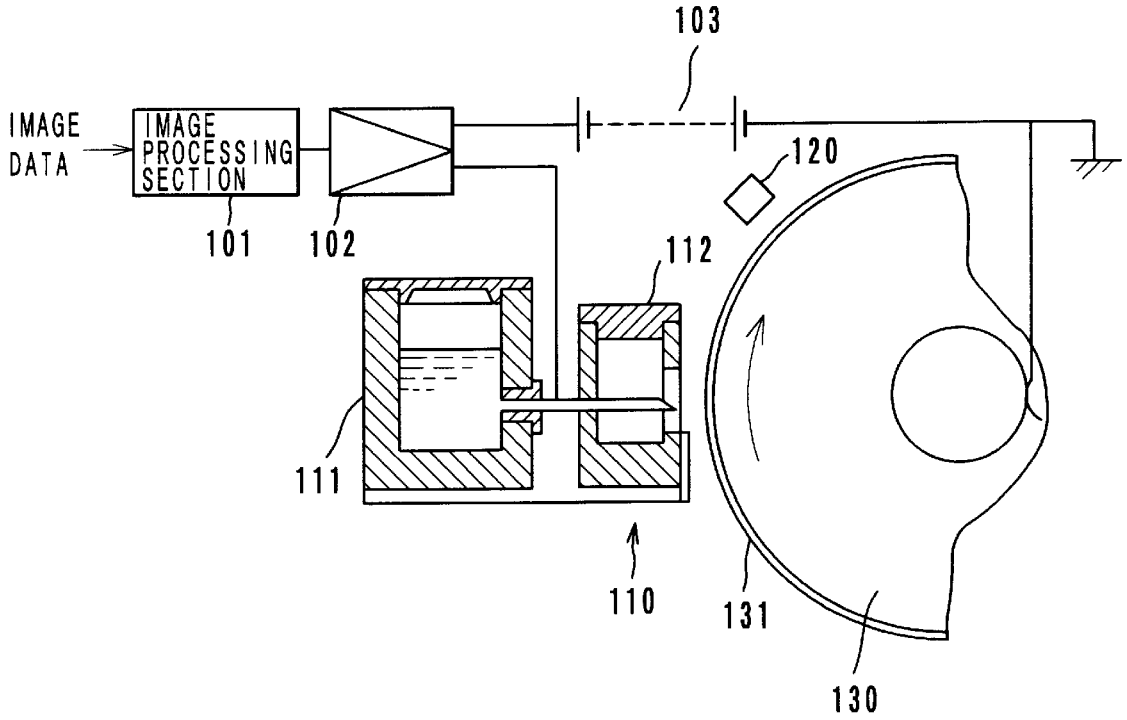
FIG. 9 is a schematic view of an image forming apparatus according to a second embodiment of the present invention.

FIG. 9 shows an image forming apparatus according to the second embodiment of the present invention. This apparatus forms an image directly on a sheet using the inkjet process. This apparatus is composed of an image processing section 101 for converting image data into printing data, a printing head section 110 which is controlled via an amplifier 102 based on the printing data so as to spray ink onto a sheet 131, and a drum 130 for feeding the sheet 131 to the printing head section 110. The printing head section 110 has an ink collecting section 111 and a nozzle 112 for spraying ink. A bias voltage of necessary value is applied from a bias power source circuit 103 to the drum 130. Moreover, an AIDC sensor 120 composed of a light emitting element and a light receiving element is provided above the printing head section 110.

Figure 10:
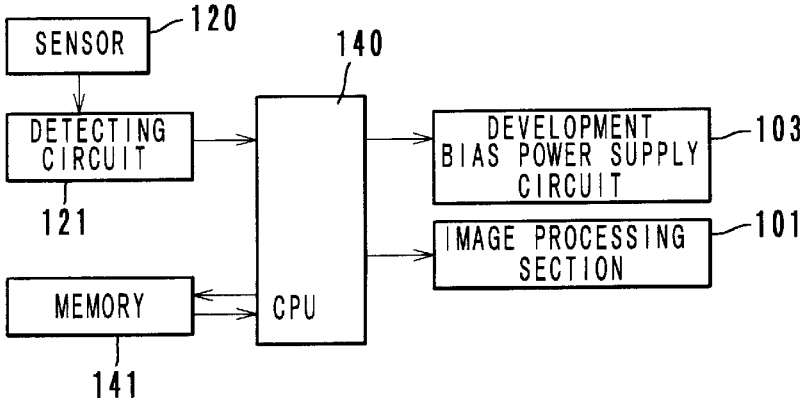
FIG. 10 is a block diagram showing the main section of a control circuit of the image forming apparatus.

The control circuit is shown in FIG. 10, and its structure is basically the same as that of the control circuit shown in FIG. 2.

In this image forming apparatus, plural test patterns whose image forming levels are different are formed on the sheet 131, and in order to obtain predetermined density reproducibility based on the density value detected by the sensor 120, printing conditions are controlled, for example, the bias voltage applied to the drum 130 is controlled, and/or image editing processes such as γ correction performed in the image processing section 101 are controlled.

The present invention can be applied not only to a digital-type copying machine or printer but also to an analog-type copying machine which allows the toner to be attracted to high-potential portions of the photosensitive layer so as to perform normal development. Particularly, when the present invention is applied to a full-color image forming apparatus, more effective image stabilization control can be achieved.

In addition, the test patterns detected on the image carrier for AIDC may be not only toner patterns but also electric potential patterns. In this case, an electric potential pattern, to which electric charges are supplied by a charger, or an electric potential pattern, in which electric charges are slightly eliminated by an exposing device, is detected by an electric potential sensor.

Further, the arrangement may be such that a toner density in the developing device is detected directly by a magnetic sensor, etc. for control of toner supply and that AIDC is solely for control of the image forming conditions on the image carrier.

Although the present invention has been described in connection with the preferred embodiments above, it is to be noted that various changes and modifications are apparent to a person skilled in the art. Such changes and modifications are to be understood as being within the scope of the present invention.

What is claimed is:

1. An image forming apparatus comprising:

an image carrier;

an image forming device for forming an image based on image data and for forming a plurality of test patterns on the image carrier, each test pattern having an image forming level;

a detecting device for detecting the image forming level of each test pattern; and a control device for controlling image forming conditions of the image forming device based on detected results of the detecting device, wherein at least one test pattern is formed every time a specified number of image forming processes are completed and the image forming level of each test pattern being different from the image forming level of an immediately previously formed test pattern.

2. A method of operating an image forming apparatus comprising an image carrier, and an image forming device for forming an image based on image data, the method comprising the steps of;

forming a plurality of test patterns on the image carrier every time a specified number of image forming processes are completed, each test pattern having a different image forming level from an immediately previously formed test pattern image forming level;

detecting the image forming level of each test pattern; and controlling image forming conditions of the image forming device based on the detected results of the detecting device.

3. An image forming apparatus for developing an electrostatic latent image formed on an image carrier and transferring the developed image onto a sheet, the apparatus comprising:

a test pattern forming device for forming a plurality of test patterns on the image carrier, each test pattern having an image forming level;

a detecting device for detecting the image forming level of each test pattern; and a control device for controlling the test pattern forming device to form a test pattern having a different image forming level from the image forming level in an immediately previously formed test pattern every time a specified number of image forming processes are completed, and controlling an image forming condition based on detected results of the detecting device.

4. The image forming apparatus as claimed in claim 3, wherein the control device stores and updates the detected results of each test pattern so as to control an image forming condition for a next image forming process.

5. The image forming apparatus as claimed in claim 3, wherein:

each test pattern formed on the image carrier by the test pattern forming device is a toner pattern with a different density from adjacent test patterns; and the detecting device detects the density of each test pattern.

6. The image forming apparatus as claimed in claim 3, wherein:

each test pattern formed on the image carrier by the test pattern forming device is an electric potential pattern with a different electric potential from adjacent test patterns; and the detecting device detects the electric potentials of each test pattern.

7. The image forming apparatus as claimed in claim 3, wherein the image forming condition controlled by the control device is at least one of toner density in a developing device, a charging voltage of the image carrier, an exposed light amount, a development bias voltage and a $\gamma$ correction coefficient.

8. The image forming apparatus as claimed in claim 3, wherein the test pattern forming device forms the test patterns one by one in a specified order every time an image forming process is completed.

9. The image forming apparatus as claimed in claim 3, wherein the test pattern forming device forms the test patterns one by one in a specified order every time a specified number of image forming processes are completed.

10. The image forming apparatus as claimed in claim 3, wherein the test pattern forming device forms two different test patterns in a specified order every time an image forming process or a specified number of image forming processes are completed.

11. A method of controlling an image forming condition in an image forming apparatus for developing an electrostatic latent image formed on an image carrier and transferring the developed image onto a sheet, the method comprising the steps of:

forming a plurality of test patterns on the image carrier by a test pattern forming device, each test pattern having an image forming level;

detecting the image forming level of each the test pattern by a detecting device;

controlling the test pattern forming device to form a test pattern having a different image forming level from the image forming level in an immediately previously formed test pattern every time a specified number of image forming processes are completed; and controlling an image forming condition based on detected results of the detecting step.

12. The method of controlling an image forming condition as claimed in claim 11, further comprising the steps of:

storing and updating the detected results of each test pattern by the controlling device so as to control an image forming condition for a next image forming process.

13. The method of controlling an image forming condition as claimed in claim 11, wherein:

each test pattern formed on the image carrier by the test pattern forming device is a toner pattern with a different density from the immediately previously formed test pattern; and the method further comprises the step of: detecting the density of each test pattern by the detecting device.

14. The method of controlling an image forming condition as claimed in claim 11, wherein:

each test pattern formed on the image carrier by the test pattern forming device is an electric potential pattern with a different electric potential from adjacent test patterns; and the method further comprises the step of: detecting the density of each test pattern by the detecting device.

15. The method of controlling an image forming condition as claimed in claim 11, wherein the step of controlling the image forming condition includes controlling at least one of toner density in a developing device, a charging voltage of the image carrier, an exposed light amount, a development bias voltage and a $\gamma$ correction coefficient.

16. The method of controlling an image forming condition as claimed in claim 11, wherein the step of forming a plurality of test patterns includes forming the test patterns one by one in a specified order every time an image forming process is completed.

17. The method of controlling an image forming condition as claimed in claim 11, wherein the step of forming a plurality of test patterns includes forming the test patterns one by one in a specified order every time a specified number of image forming processes are completed.

18. The method of controlling an image forming condition as claimed in claim 11, wherein the step of forming a plurality of test patterns includes forming two different test patterns in a specified order every time an image forming process or a specified number of image forming processes are completed.

* * * * *